US007436366B2

(12) United States Patent
Takisawa et al.

(10) Patent No.: US 7,436,366 B2
(45) Date of Patent: Oct. 14, 2008

(54) ANTENNA DEVICE

(75) Inventors: Hisashi Takisawa, Akita (JP); Junichi Noro, Akita (JP); Kyuichi Sato, Akita (JP); Takao Kato, Akita (JP); Arata Togashi, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 33 days.

(21) Appl. No.: 11/617,222

(22) Filed: Dec. 28, 2006

(65) Prior Publication Data

US 2007/0164917 A1 Jul. 19, 2007

(30) Foreign Application Priority Data

Jan. 18, 2006 (JP) ..... P2006-009362
Jan. 18, 2006 (JP) ..... P2006-009382
Jan. 18, 2006 (JP) ..... P2006-009434

(51) Int. Cl.
*H01Q 1/32* (2006.01)

(52) U.S. Cl. ..... 343/711; 343/713; 343/882

(58) Field of Classification Search ..... 343/711, 343/713, 702, 878, 880, 882
See application file for complete search history.

(56) References Cited

U.S. PATENT DOCUMENTS 7,236,140 B2 * 6/2007 Vainer ..... 343/878
2006/0023411 A1 * 2/2006 Ryu et al. ..... 361/683

FOREIGN PATENT DOCUMENTS

| | | |
|---|---|---|
| JP | 2004-289514 | 10/2004 |
| JP | 2005-20644 | 1/2005 |
| JP | 2005-109688 | 4/2005 |

* cited by examiner

*Primary Examiner*—Hoang V Nguyen
(74) *Attorney, Agent, or Firm*—Whitham Curtis Christofferson & Cook, PC

(57) ABSTRACT

A hinge portion is formed on the base portion. An antenna portion is attached to the hinge portion so as to be pivotable thereabout. The hinge portion includes a hinge base having a first shaft formed on one end thereof, a second shaft formed on the other end thereof, and a first protrusion formed on an outer periphery of the second shaft, and a hinge bush rotatably mounted on the first shaft and engaged with the antenna portion. The antenna portion is formed with a hole surrounding the outer periphery of the second shaft. A projection is formed on an inner periphery of the hole. The first protrusion is brought into contact with the projection when the antenna portion is pivoted so as to define a predetermined angle with respect to the base portion.

8 Claims, 7 Drawing Sheets

11

113
114

11
113
C
A
A
114
C 11
113

113
11

A – A

B – B

ANTENNA DEVICE

The disclosure of Japanese Patent Application Nos. 2006-0009362 filed Jan. 18, 2006, 2006-009382 filed Jan. 18, 2006, and 2006-009434 filed Jan. 18, 2006, including specifications, drawings and claims is incorporated herein by reference in their entirety.

BACKGROUND

The present invention relates to an antenna device operable to receive an electric wave of digital radio broadcasting.

A digital radio receiver which is operable to receive a satellite wave or ground wave and allows a person to hear digital radio broadcasting has been developed, and has been put to practical use in United States. The digital radio receiver can be mounted on a mobile station, such as a vehicle, or can be installed inside a building to receive an electric wave the frequency band of which is about 2.3 GHz and to allow a person to hear the radio broadcasting. Since the frequency of the received electric wave is about 2.3 GHz, a received wavelength (resonant wavelength) $\lambda$ is about 128.3 mm. In addition, once the satellite wave is received at the earth station, the frequency thereof is shifted a little and is retransmitted as a linearly polarized wave that is the ground wave.

Since an electric wave having a frequency band of about 2.3 GHz is used in the digital radio broadcasting, it is preferable that an antenna device receiving the electric wave is installed outdoors. Therefore, when the digital radio receiver is mounted on a vehicle or the like, it is provided, for example, in the outside of the vehicle such as a roof thereof in many cases. On the other hand, when the digital radio receiver is used inside a building, the antenna device is installed in a roof, a balcony or the like in many cases.

Here, the directional sensitivity of this type of antenna device is omni-directional. However, in order to ensure the best sensitivity, the antenna device is required to be constructed such that the wave angle of the antenna device is adjusted to avoid an electric wave shielding object. The related-art antenna device for home use which has an angle adjustment function is disclosed in, for example, Japanese Patent Publication No. 2004-289514A. The related-art antenna device disclosed in Japanese Patent Publication No. 2004-289514A includes a base portion, and an antenna portion the angle of which is adjustable with respect to the base portion via a hinge portion. The hinge portion has a hinge base, two hinge bushes, two coil springs, two washer, and two screws. The hinge base is formed on an end of a ceiling surface of the base case of the base portion, and has two tapered shafts protruding from both ends of the hinge base, respectively. Each of the hinge bushes has a tapered inner peripheral surface and is fitted into each of the shafts of the hinge base. The coil spring is fitted into each of the shafts on which the hinge bush is mounted. A screw is fastened via the washer to an end surface of each of the shafts on which the hinge bush and the coil spring are mounted. The biasing force of the spring generates a frictional force between the outer peripheral surface of the shaft of the hinge base and the inner peripheral surface of the hinge bush when the hinge bush rotates. The antenna portion is joined to the hinge bush and is capable of being opened and closed at an arbitrary angle relative to the base portion. The frictional force between the shaft of the hinge base and the hinge bush causes the antenna device to be fixed at a constant angle without rotation when an external force is not applied thereto. On the other hand, when an external force larger than the frictional force between the shaft of the hinge base and the hinge bush is applied to the antenna portion, the antenna portion rotates, and can be adjusted to an arbitrary angle. The angle adjustment is performed as follows, for example. A user manually adjusts the angle of the antenna portion such that the best level of a broadcasting signal or the best sound quality of audio information received by a digital radio receiver is maintained, while confirming the level or the sound quality.

As described above, in the related-art antenna device including the example described in Japanese Patent Publication No. 2004-289514A, the number of the hinge bush, the coil spring, the washer, and the screw is two, respectively. For this reason, it is disadvantageous in decreasing the size and the weight of the antenna device. Also, since the cost of parts is high and since a number of manufacturing processes are required, it is disadvantageous the decreasing the cost thereof.

A satellite wave, especially a circularly polarized wave is used for digital radio broadcasting. As disclosed in Japanese Patent Publication No. 2005-20644A, an related-art antenna device including an antenna module corresponding to the circularly polarized wave has a ground plate, an antenna plate disposed to face the ground plate at a distance therefrom, an antenna probe disposed between the ground plate and the antenna plate, and a probe holder made of resin for holding the antenna probe. The probe holder is formed with a groove portion in which the antenna probe is to be disposed. A member made of an insulating material, such as a tape, for electrically insulating the antenna probe and the antenna plate is attached onto the ceiling surface of the probe holder in which the antenna probe is to be disposed.

For the purpose of realizing miniaturization, lightness, reliability, and cost reduction of the antenna device including the related-art antenna device disclosed Japanese Patent Publication No. 2005-20644A, it is effective to realize miniaturization, lightness, reliability, and cost reduction of the antenna module. Specifically, it is considered that, for example, the ground plate and the antenna plate is miniaturized. However, in a case where the ground plate and the antenna plate are miniaturized, there is a possibility that an electrostatic capacitance of the antenna module, which is required for the antenna device to exhibit a sufficient gain, may decrease.

An antenna device used for a GPS (global positioning system) using a satellite wave similarly to a digital radio broadcasting system, particularly an antenna device suitable for being installed on a roof of a vehicle is disclosed in Japanese Patent Publication No. 2005-109688A. The related-art antenna device disclosed in Japanese Patent Publication No. 2005-109688A includes a top cover, a bottom cover, an antenna module, a packing member, and a signal line. Since the packing member is disposed in a connecting portion between the bottom plate and the top plate to ensure adherence therebetween to perform a water-proof function, it is also called as a water-proof packing. The packing member has a generally angular-shaped plate part including a wide angular-shaped frame part and a bush part covering the periphery of the signal line in the position of a cut-out portion formed in the top cover. Since the frame part and the bush part are integrally formed with each other, the number of parts and manufacturing processes is small compared to a case in which the both members are separately formed. The water-proof function is realized as follows. A water-proof rib having an angular and frame shape is formed inside the top cover to correspond to the angular-shaped frame part of the plate part of the packing member. The-packing member and the bottom plate are fastened to the top cover with a plurality of screws. The fastening pressure at this time causes the leading end of the water-proof rib of the top cover to be pressed against the angular-shaped frame part of the packing member, thereby realizing the water-proof function.

As described above, in the antenna device including the related-art antenna device disclosed in Japanese Patent Publication No. 2005-109688A, when the fastening pressures by the plurality of screws are different from one another or the fastening pressures by the screws are too large, there is a possibility that a gap may be formed between the water-proof rib formed in the top cover and the packing member. As a result, there is a possibility that the water-proof property realized by the packing member may deteriorate.

SUMMARY

It is therefore an object of the present invention to provide an antenna device which is small in size and light in weight, and which is low in cost because the cost of parts and the number of manufacturing processes is small.

It is also an object of the invention to provide an antenna device which is small in size, light in weight and low in cost, while the antenna device can exhibit a high gain.

It is also an object of the invention to provide an antenna device having an excellent water-proof property.

In order to achieve the above described objects, according to the invention, there is provided an antenna device, comprising:

a base portion;

a hinge portion formed on the base portion;

an antenna portion attached to the hinge portion so as to be pivotable thereabout, wherein:

the hinge portion includes:

a hinge base having a first shaft formed on one end thereof, a second shaft formed on the other end thereof, and a first protrusion formed on an outer periphery of the second shaft; and a hinge bush rotatably mounted on the first shaft and engaged with the antenna portion;

the antenna portion is formed with a hole surrounding the outer periphery of the second shaft;

a projection is formed on an inner periphery of the hole; and the first protrusion is brought into contact with the projection when the antenna portion is pivoted so as to define a predetermined angle with respect to the base portion.

According to the invention, there is also provided antenna device, comprising:

an antenna portion;

a hinge portion formed on the antenna portion;

a base portion attached to the hinge portion so as to be pivotable thereabout, wherein:

the hinge portion includes:

a hinge base having a first shaft formed on one end thereof, a second shaft formed on the other end thereof, and a first protrusion formed on an outer periphery of the second shaft; and a hinge bush rotatably mounted on the first shaft and engaged with the base potion;

the base portion is formed with a hole surrounding the outer periphery of the second shaft;

a projection is formed on an inner periphery of the hole; and the first protrusion is brought into contact with the projection when the base portion is pivoted so as to define a predetermined angle with respect to the antenna portion.

The antenna portion may be operable to pivot about the hinge portion in a first direction.

The hinge base may have a second protrusion formed on the outer periphery of the second shaft.

The antenna portion may have a wall portion formed on the inner periphery of the antenna portion.

The wall portion may be brought into contact with the second protrusion so that the antenna portion is not pivot in the first direction when the antenna portion defines a right angle with respect to the base portion.

The base portion may be operable to pivot about the hinge portion in a first direction.

The base portion may have a wall portion formed on the inner periphery of the base portion.

The wall portion is brought into contact with the second protrusion so that the base portion is not pivot in the first direction when the base portion defines a right angle with respect to the antenna portion.

The hinge bush may be comprised of at least one of ABS resin, ASA resin, and PC resin.

With this configuration, the antenna device is small in size and is light in weight, and the antenna device is low in cost the cost of parts is low and the number of manufacturing processes is small.

According to the invention, there is also provided an antenna device, comprising:

a ground plate adapted to be electrically grounded;

an antenna plate;

an antenna probe feeding to the antenna plate;

a probe holder which is comprised of resin, interposed between the ground plate and the antenna plate, and holding the antenna probe, wherein:

an area of the probe holder is equal to or larger than at least one of an area of the ground plate and an area of the antenna plate.

A face of the probe holder, which opposes the antenna plate may be formed with a groove.

The antenna probe may be inserted into the groove.

A projection may be formed in the groove so as to hold the antenna probe in the groove A depth of the groove and a position in the groove where the projection is formed may be set so that the antenna probe is disposed at a predetermined distance from the antenna plate so as to be electrically insulated from the antenna plate.

The antenna device may further comprise:

a ground member which is comprised of metal, disposed under the ground plate, and an area of which is equal to or larger than the ground plate, wherein:

electric potential of the ground member is equal to electric potential of the ground plate.

The ground member may include at least one of a metal sheet, a metal sheet adhered on a bottom cover of the antenna device, and conductive coating material coating the bottom cover of the antenna device.

With this configuration, the antenna device is small in size, is light in weight and is low in cost, while the antenna device can exhibit a high gain. Further, the antenna device exhibits an excellent shielding effect against both an incoming noise and a radiation noise.

According to the invention, there is also provided An antenna device, comprising:

a first cover;

a second cover coupled to the first cover and defining a space therebetween;

an antenna module accommodated in the space;

a signal line electrically connected to the antenna module and led out from the space;

a packing member interposed between the first cover and the second cover so as to close the space in a waterproofing manner, wherein:

the packing member includes a frame portion formed with a groove and a bush portion into which the signal line fitted; and the second cover includes a rib fitted into the groove.

A width of the groove may be substantially equal to a thickness of the rib.

The antenna module may be accommodated within the frame.

The packing member may be comprised of silicone rubber.

The rib may include a rib end portion disposed in the vicinity of the bush portion.

The groove may include a groove end portion disposed in the vicinity of the bush portion.

The rib end portion may be fitted into the groove end portion.

The antenna device according to the present invention has an excellent water-proof property.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, an embodiment of an antenna device according to the invention will be discussed with reference to the accompanying drawings.

An antenna device according to the present invention is an antenna device for a digital radio receiver, and particularly an antenna device for home use assuming that the antenna device is also installed in outdoor places, such as a roof and a balcony, in addition to indoors, and is connected to a digital radio receiver installed indoors.

The directional sensitivity of the antenna device is omni-directional. However, in order to ensure best sensitivity, it is desirable that the antenna device is constructed such that the attachment angle of the antenna device is adjusted to avoid an electric wave shielding object. For this reason, the present antenna for home use has an angle adjustment function.

Figure 1:
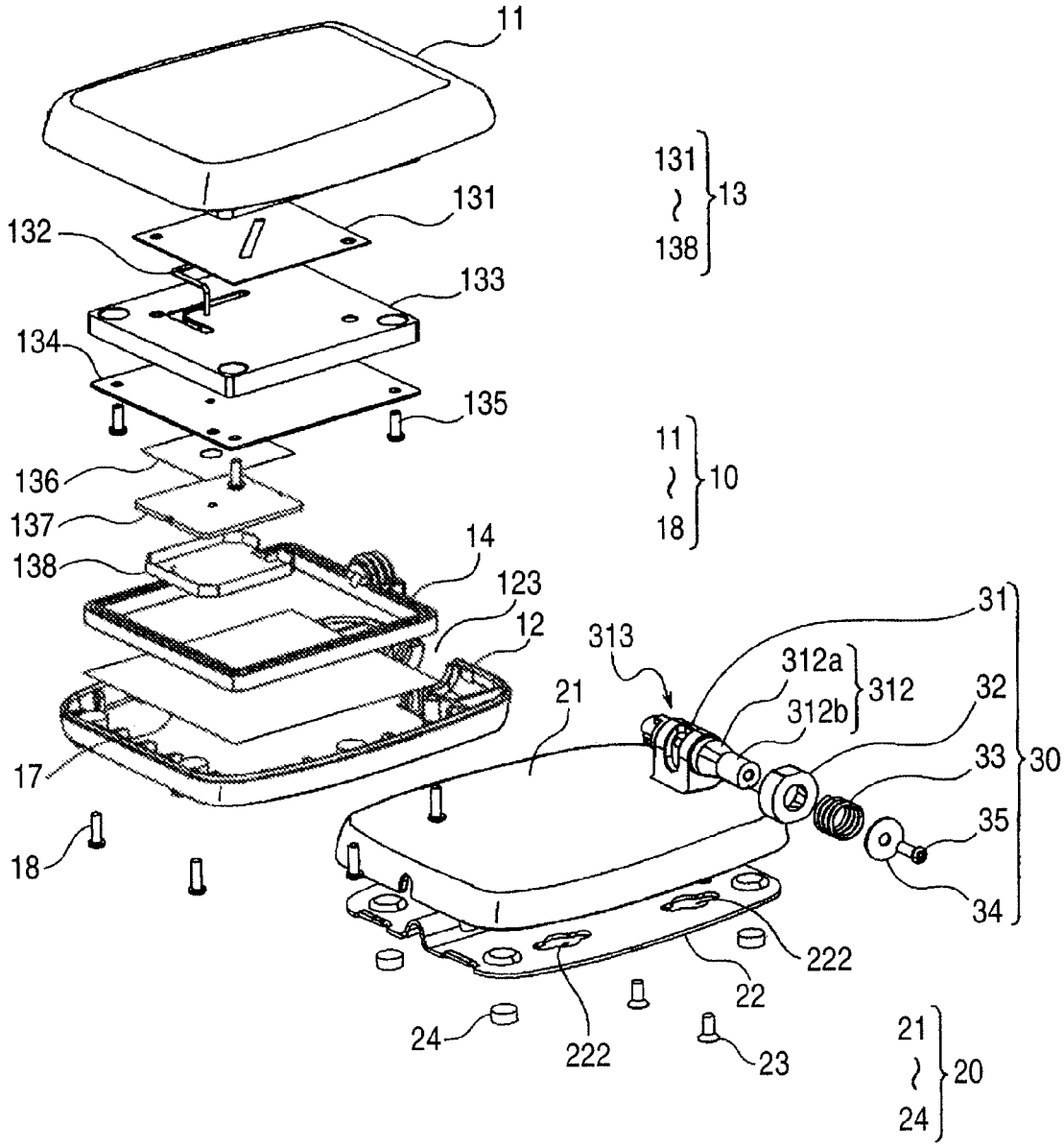
FIG. 1 is a schematic exploded view showing an antenna device according to an embodiment of the present invention.

As shown in FIG. 1, the antenna device according to the present invention has the angle adjustment function. Specifically, the present antenna device has a base portion 20 which can be attached to a wall surface or the like, an antenna portion 10 accommodating an antenna module 13, and a hinge portion 30 for connecting the antenna portion 10 to the base portion 20 such that the angle therebetween can be adjusted.

The base portion 20 includes a base case 21 and a base plate 22. The base case 21 and the base plate 22 are coupled together using a plurality of screws 23. Four rubber pads 24 are adhered to the base plate 22. The present antenna device can be mounted inside an oriel window of a building. Further, the base plate 22 is provided with hooking holes 222, the present antenna device can be hooked and attached to screws or hooks provided in a wall.

The antenna portion 10 includes a top cover 11, a bottom cover 12, an antenna module 13 which is mounted inside the top cover, a packing member 14, and a ground sheet 17 (the detailed description thereof will be made below). The top cover 11 and the bottom cover 12 are coupled together by a plurality of screws 18.

Figure 2A:
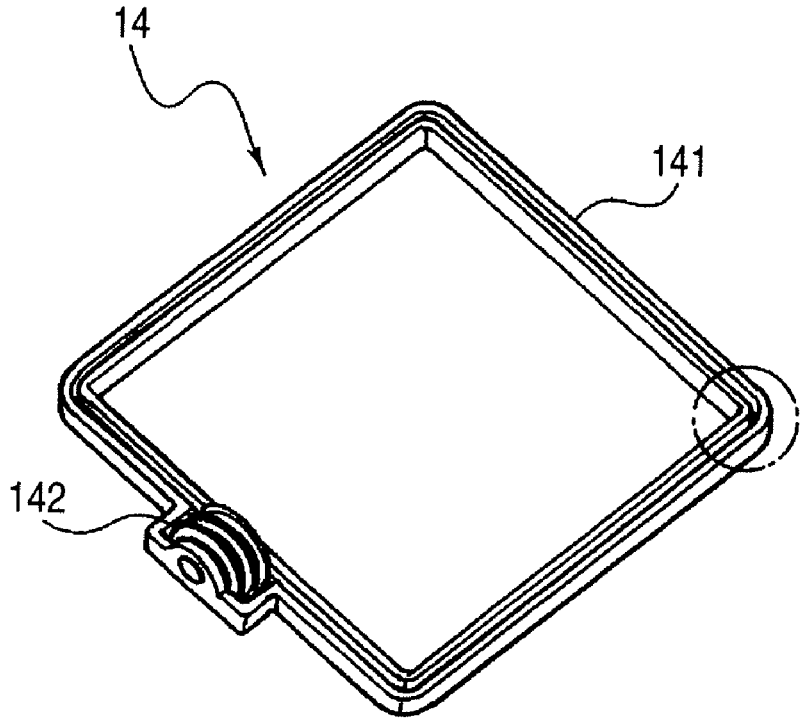
FIGS. 2A and 2B are respectively a perspective view and a partially enlarged view showing a packing member of the antenna device shown in FIG. 1.
Figure 2B:
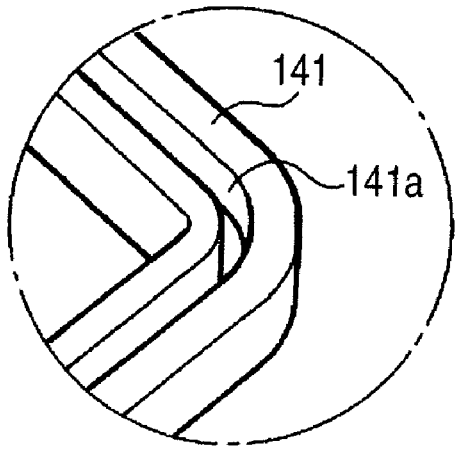

The packing member 14 is made of, for example, a resin material, such as silicone rubber or EPDM rubber(ethylene propylene rubber). Since the packing member 14 is arranged at a connecting portion between the bottom cover 12 and the top cover 11 to ensure the adherence therebetween to perform a water-proof function, it is also called as a water-proof packing. As shown in FIG. 2A, the packing member 14 has a frame part 141 having a rectangular frame shape with large width, and a bush part 142 covering the periphery of a signal line (not shown) at the position of a cut-out part 123 formed at the top cover 11. Since the packing member 14 is constructed such that the frame part 141 and the bush part 142 are integrally formed, the number of parts and manufacturing processes is small compared to the case in which both the members are separately formed. The packing member 14 is useful in terms of miniaturization, lightness, reliability, and cost reduction.

Figures 4A, 4B, 4C, 4D, 4E:
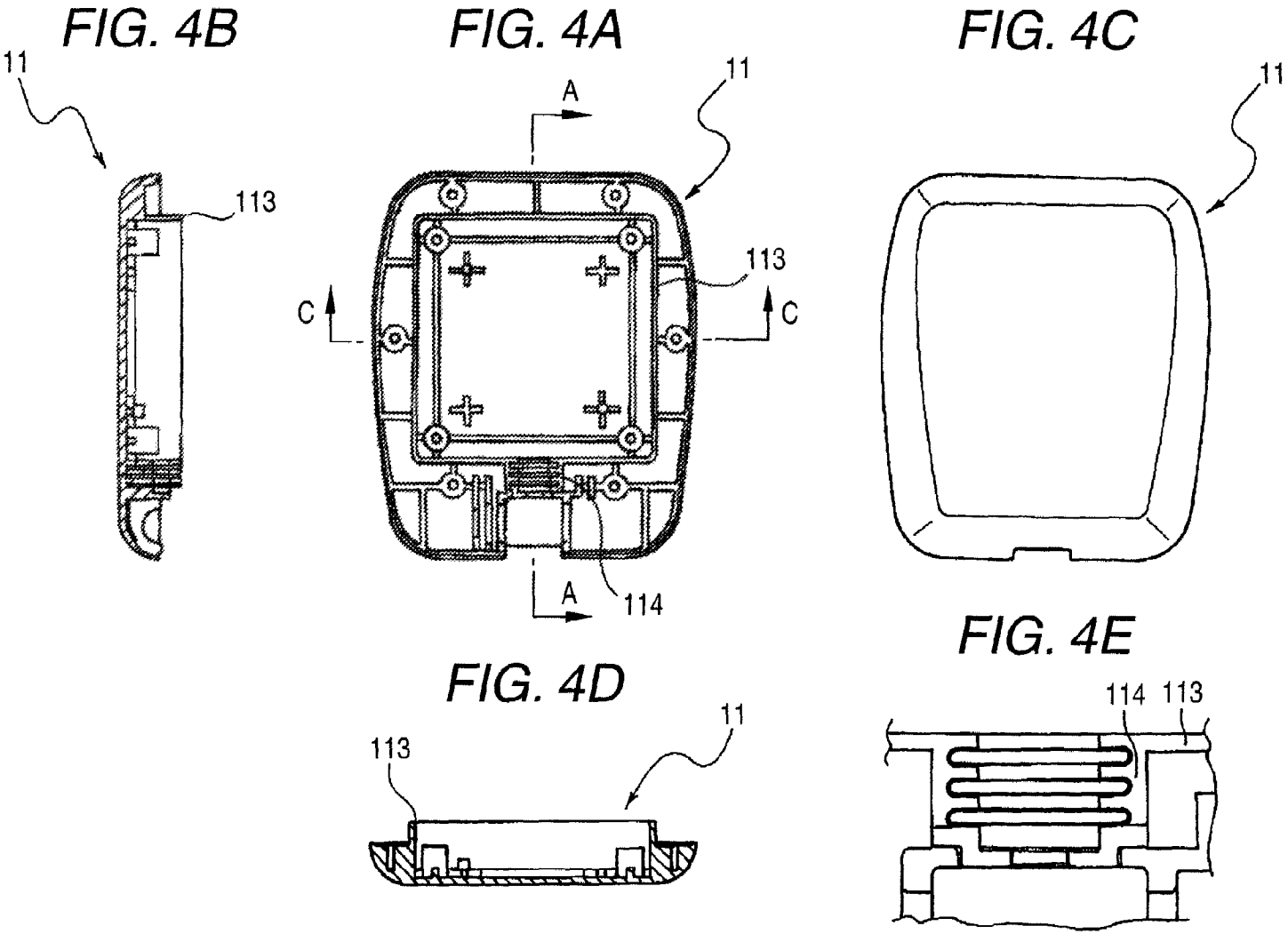
FIGS. 4A to 4E are respectively a bottom view, a cross-sectional view, a plan view, another bottom view, and a partially enlarged view showing the top cover of the antenna device shown in FIG. 1.
Figure 5:
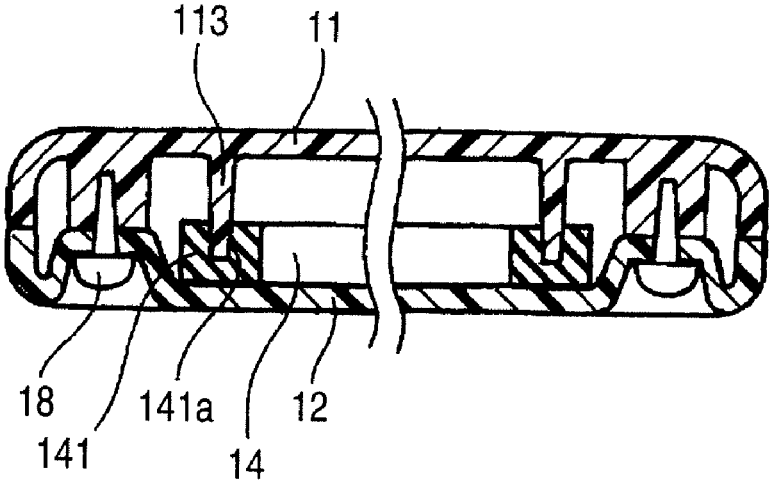
FIG. 5 is a partial cross-sectional view showing a water-proof structure of the antenna device according to the embodiment of the present invention.

The present antenna device has a water-proof structure realizing a water-proof function between the top cover 11 and the bottom cover 12. As shown in FIGS. 4A to 4E, a water-proof lib 113 protruding in a generally rectangular frame shape is formed inside the top cover 11. On the other hand, as shown in FIGS. 2B, 3A to 3D, the generally rectangular-shaped frame part 141 of the packing member 14 is provided with a generally rectangular and frame-shaped groove 141*a* which corresponds to the protruded water-proof rib 113 having the generally rectangular frame shape. When the bottom cover 12 and the top cover 11 are assembled together with the packing member 14 therebetween, a leading end of the water-proof lib 113 of the top cover 11, as shown in FIG. 5, fits into the groove 141*a* of the frame part 141 of the packing member 14. Further, when the top cover 11 and the bottom cover 12 are fastened together using the plurality of screws 18, the water-proof rib 113 is pressed against the groove 141*a*, thereby realizing the water-proof function. The width of the groove 141*a* is substantially equal to the thickness of the water-proof rib 113.

Figures 3A, 3B, 3C, 3D:
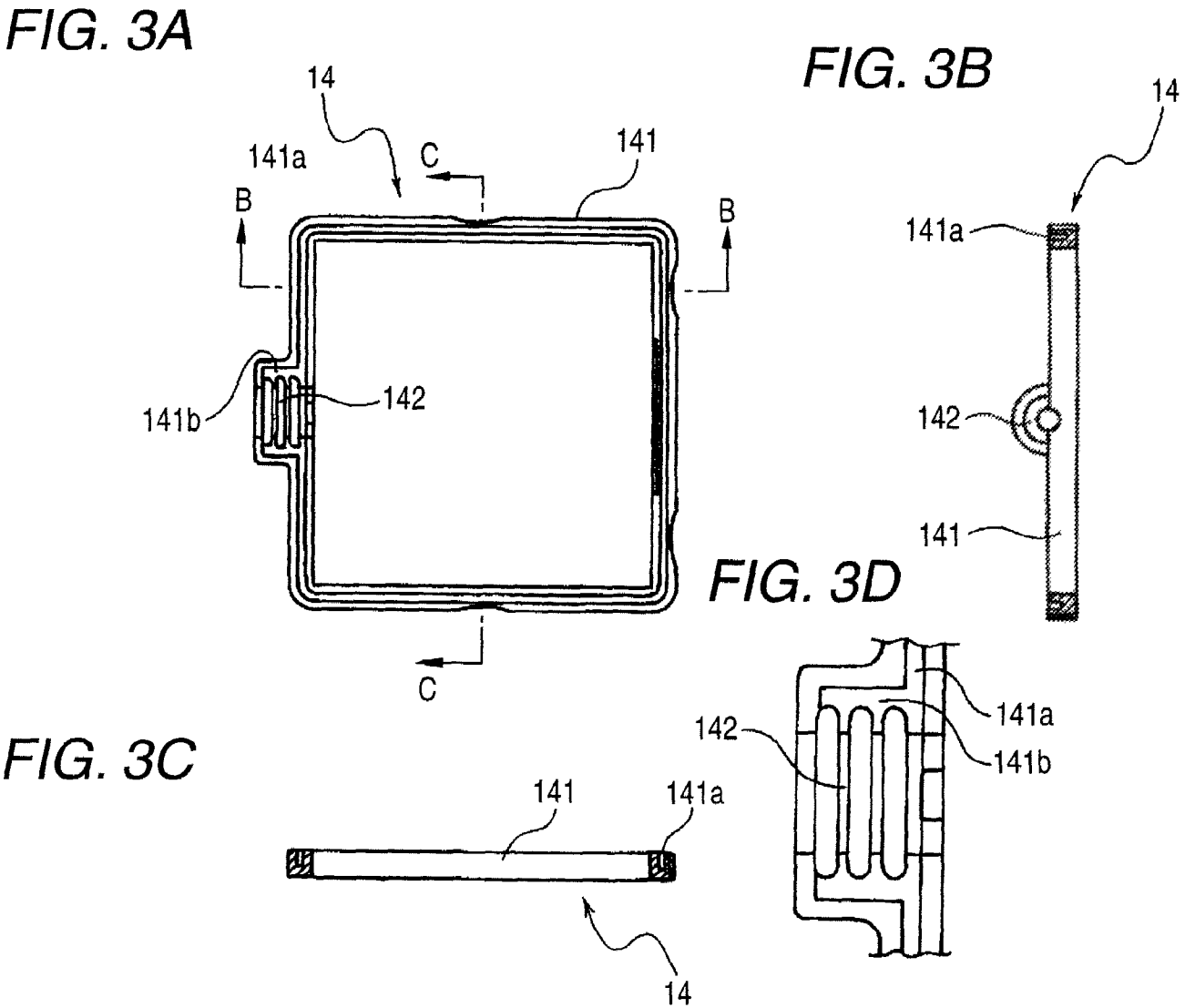
FIGS. 3A to 3D are respectively a plan view, a cross-sectional view, another cross-sectional view, and a partially enlarged view showing the packing member shown in FIG. 1.

Further, in the generally rectangular-shaped frame part 141 of the packing member 14, as shown in FIG. 3D, a groove end 141*b* which continues from the groove 141*a* is formed to the vicinity of the bush part 142. The groove end 141*b* has a pocket shape. On the other hand, as shown in FIG. 4E, a rib end 114 which continues from the water-proof rib is formed inside the top cover 11. In the protruded portion of the signal line, the bush part 142 is fitted into a bush accommodating portion of the top cover 11, thereby exhibiting a water-proof effect, as well as the rib end 114 is fitted into the groove end 141*b*, thereby increasing a water-proof property.

In the water-proof structure of the present antenna device, the contact area between the packing member 14 and the water-proof rib 113 is large. For this reason, any gap is not created between the water-proof rib 113 of the top cover 11 and the packing member 14, even in a case in which the fastening pressures by the plurality of screws 18 are different from one another, or the fastening pressures by the screws 18 are relatively large. Therefore, the present antenna device has an excellent water-proof property. Further, when the water-proof rib 113 of the top cover 11 fits into the groove 141*a* of the packing member 14, the packing member 14 is not dislocated in the horizontal direction.

Figure 6A:
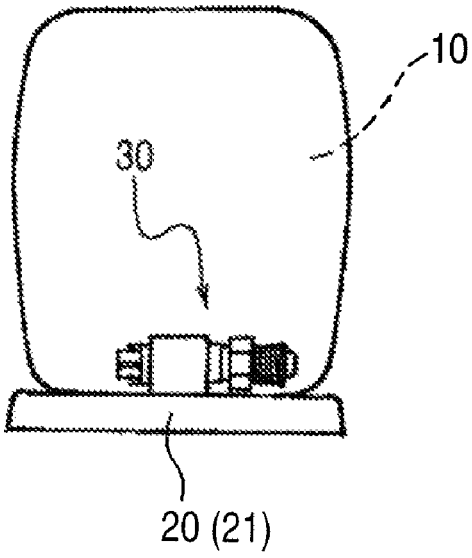
FIGS. 6A and 6B are views showing an angle adjusting structure of the antenna device according to the embodiment of the present invention.
Figure 6B:
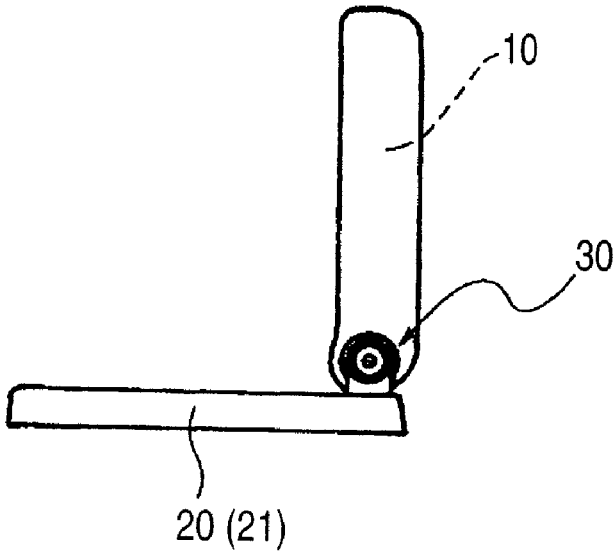

In the present antenna device, the angle of the antenna portion 10 with respect to the base portion 20 can be adjusted via the hinge portion 30. As shown in FIGS. 1, 6A and 6B, the hinge portion 30 includes a hinge base 31, a hinge bush 32, a coil spring 33, a washer 34 and a screw 35. The hinge base 31 is provided at an end of a ceiling surface of a base case 21 of the base portion 20, and extends parallel to the ceiling surface of the base case 21. An end of the hinge base 31 is formed with a first shaft 312. The first shaft 312 has a base 312*a* having a tapered outer peripheral surface and a shaft-body-shaped leading end 312*b* extending from the base 312*a*. The hinge bush 32 is made of a low frictional resin material, such as ABA, ASA, or PC, has a tapered inner peripheral surface, and is fitted around the base 312*a* of the first shaft 312 such that it can rotate with friction. The coil spring 33 is fitted onto the leading end 312*b* on which the hinge bush 32 is mounted. The screw 35 is fastened via the washer 34 to an end surface of the first shaft 312 on which the hinge bush 32 and the coil spring 33 is mounted. The biasing force of the coil spring 33 generates a frictional force between the outer peripheral surface of the base 312*a* of the first shaft 312 and the inner peripheral surface of the hinge bush 32 to cause the hinge bush 32 to slide with respect to the first shaft 312.

The hinge bush 32 is sandwiched and fixed between the top cover 11 and the bottom cover 12. The frictional force between the base 312*a* of the first shaft 312 and the hinge bush 32 causes the antenna portion 10 to be fixed at a constant angle without rotation when an external force is not applied thereto. On the other hand, the antenna portion 10 can be rotated and adjusted to an arbitrary angle when an external force larger than the frictional force between the base 312*a* of the first shaft 312 and the hinge bush 32 is applied thereto.

In the present invention, the angle of the hinge portion 30 can be adjusted within a range of 0 to 90 degrees. The angle adjustment is performed as follows, for example. A user manually adjusts the angle of the antenna portion 10 such that the best level of a broadcasting signal or the best sound quality of audio information received by a digital radio receiver via the present antenna device is maintained, while confirming the level or the sound quality.

Further, in the present invention, the hinge base may be formed at an end of the antenna, and the hinge bush may be fixed to an end of the base portion.

In the angle adjusting structure of the present antenna device, the number of the hinge bush 32 of the hinge portion 30, the coil spring 33, the washer 34, and the screw 35 is one, respectively. Therefore, the antenna device is small in size and is light in weight, and the antenna device is low in cost since the cost of parts is low and the number of manufacturing processes is small.

Figure 7A:
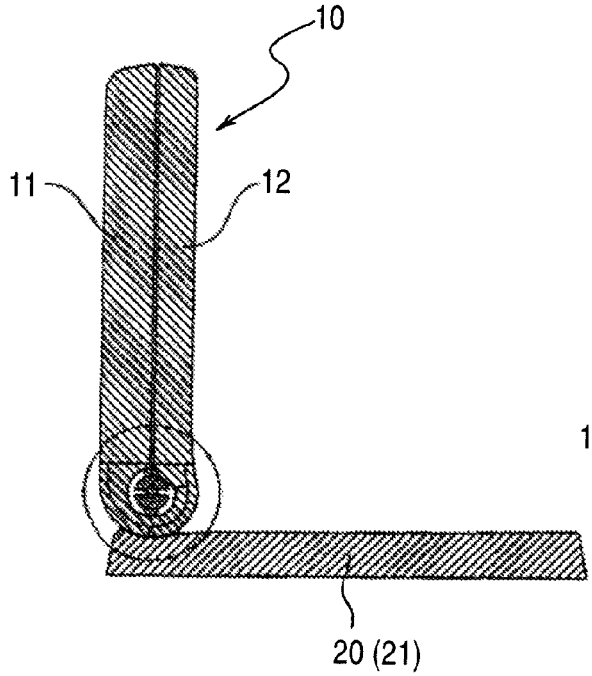
FIGS. 7A and 7B are alternative views showing an angle adjusting structure of the antenna device according to the embodiment of the present invention.
Figure 7B:
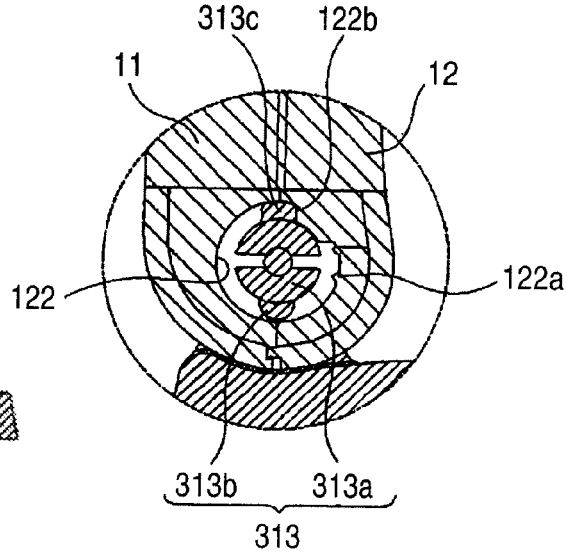
Figure 8A:
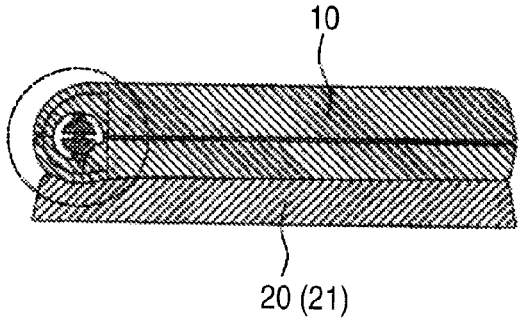
FIGS. 8A and 8B are further alternative views showing an angle adjusting structure of the antenna device according to the embodiment of the present invention.
Figure 8B:
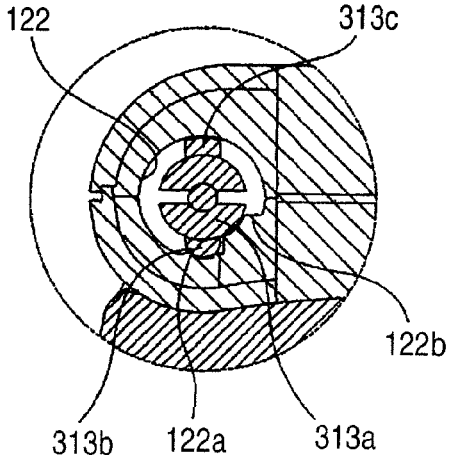

Further, As shown in FIGS. 7A and 7B and FIGS. 8A and 8B, the other end of the hinge base 31 is formed with a second shaft 313. The second shaft 313 has a pair of cantilever pieces 313*a* formed by splitting the end of a shaft body of the second shaft, and a convex portion 313*b* formed on an outer peripheral surface of one of the cantilever pieces. The cantilever piece 313*a* functions as a cantilever spring. On the other hand, inner peripheral surface portions 122 are formed at ends of the top cover 11 and the bottom over 12 so as to surround the second shaft. Each inner peripheral surface portion 122 has a protrusion 122*a* formed corresponding to a predetermined position of the convex portion 313*b* when the antenna portion 10 is opened and closed with respect to the base portion 20. In the present embodiment, the predetermined position of the convex portion 313*b* is a position just before the angle of the antenna portion 10 with respect to the base portion 20 becomes 0 degree. When the antenna portion 10 is closed toward 0 degree as shown in FIGS. 8A and 8B from a state where the antenna device is opened as shown in FIGS. 7A and 7B, the convex portion 313*b* supported by the cantilever piece 313*a* rides over the protrusion 122*a*. At this time, a click feeling is created. Further, when the antenna portion 10 is completely closed at 0 degree, the convex portion 313*b* supported by the cantilever piece 313*a* is regulated by the protrusion 122*a*. Therefore, the antenna portion 10 is not inadvertently opened (floated) as long as an external force exceeding the elastic force of the cantilever piece 313*a* is not applied thereto.

The second shaft 313 further includes a second convex portion 313*c* formed on an outer peripheral surface of the root thereof. On the other hand, the inner peripheral surface portion 122 further has a wall portion 122*b* which abuts on the second convex portion 313*c* to prevent the antenna portion 10 from having an angle larger than 90 degrees when the antenna portion 10 forms an angle of 90 degrees with respect to the base portion 20.

In addition, in the present invention, the second shaft along with the hinge base may be formed in the antenna portion, while the inner peripheral surface portion may be formed in the base portion. Further, any one of the convex portion formed in the second shaft and the protrusion formed in the inner peripheral portion has preferably a low frictional property.

As shown in FIG. 1, the antenna module 13 includes a ground plate 134, an antenna plate 131, an antenna probe 132, a probe holder 133, an LNA (low noise amplifier) 137, and a shielding case 138.

The ground plate 134 is made of metal, and has a generally square shape. The antenna plate 131 is made of metal, has a generally square shape, and is arranged to face the ground plate 134 with a distance therebetween. The antenna probe 132 is made of metal and is located between the ground plate 134 and the antenna plate 131. The probe holder 133 is made of ABS resin, has a generally cubic shape, and holds the antenna probe 132 in a fixed position.

The plate surface area of each of the ground plate 134 and the antenna plate 131 is made smaller than that of the related-art antenna device. When the ground plate and the antenna plate are miniaturized, there is a possibility that the electrostatic capacitance of the antenna module decreases and the antenna device does not exhibit a sufficient gain. However, the present antenna device increases a specific dielectric constant between the ground plate 134 and the antenna plate 131 to ensure a sufficient electrostatic capacitance. For this reason, the present antenna device can exhibit a high gain. Specifically, the probe holder 133 provided between the ground plate 134 and the antenna plate 131 has a size equal to or lager than the facing area between the ground plate 134 and the antenna plate 131. That is, most of the space between the ground plate 134 and the antenna plate 131 is filled with resin member (probe holder 133). Since the resin has a specific dielectric constant larger than that of air, the antenna module 13 has a sufficient electrostatic capacitance.

Figure 9A:
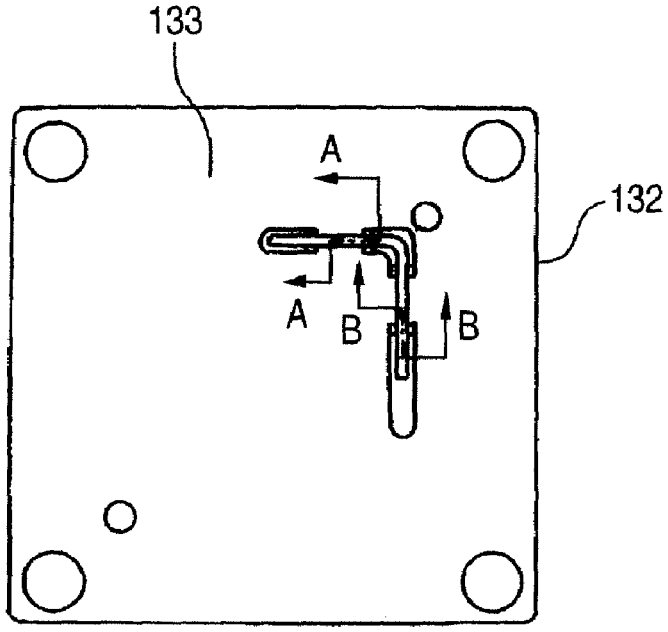
FIGS. 9A to 9C are respectively a plan view, a cross-sectional view, and another cross-sectional view showing a probe holder of the antenna device according to the embodiment of the present invention.
Figure 9B:
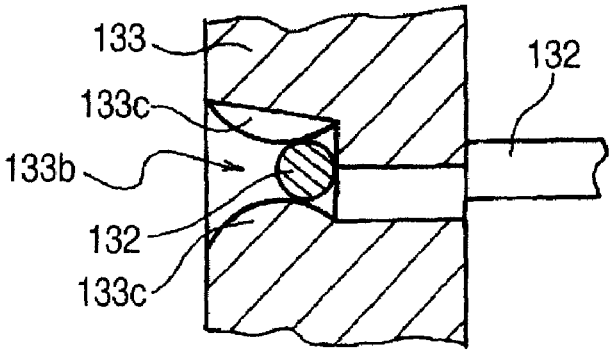
Figure 9C:
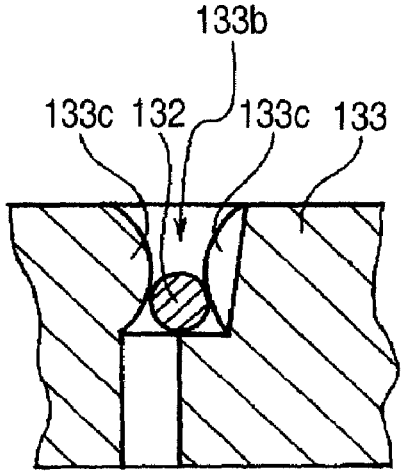

As shown in FIG. 9A to 9C, a generally L-shaped groove 133*b* is formed in a ceiling surface of the probe holder 133. The antenna probe 132 is inserted into the groove 133*b*. Since a protrusion 133*c* is formed in the groove 133*b*, the antenna probe 132 inserted into the groove 133*b* is securely held within the groove 133*b* without being removed unnecessarily. The depth of the groove 133*b* and the height of the protrusion 133*c* are set such that the antenna probe 132 held by the probe holder 133 and the antenna plate 131 are spaced from each other with a predetermined distance therebetween and are electrically insulated from each other. For this reason, an insulating member needs not to be mounted on the antenna probe held by the probe holder, whereby the number of parts of the antenna device may be reduced.

An end of the antenna probe 132 and a signal line (not shown) are electrically connected to the LNA 137. The shielding case 138 is soldered to the LNA 137. The LNA 137 covered with the shielding case 138 is adhered to the ground plate 134 with an insulating tape 136. The ground plate 134 to which the LNA 137 is adhered is attached to the inside the top cover 11 with a plurality of screws 135. The signal line is led out of the antenna portion 10 via the bush part 142 of the packing member 14 located in the cut-out position formed in the bottom cover 12.

As described above, the plate surface area of each of the ground plate 134 and the antenna plate 131 is smaller than that of the conventional one. When the ground plate is miniaturized, there is a possibility that the shielding effect against an incoming noise and a radiation noise may deteriorate. However, since the present antenna device includes an additional ground means, it has a shielding effect against the incoming noise and the radiation noise. That is, the ground means is composed of a ground sheet 17 shown in FIG. 1. The ground sheet 17 is composed of an aluminum adhesive seal, has a size equal to or larger than the area of the ground plate 134, and is adhered to an inner bottom surface of the bottom cover 12. The ground sheet 17 is arranged in a state in which it is spaced with a predetermined distance from the ground plate 134 and the shielding case 138. The additional ground means according to the present invention may be a metal plate or conductive paint applied onto the inner bottom surface of the bottom cover 12. The conductive paint may contain, for example, copper or aluminum.

The present invention has been described with reference to the preferred embodiment, but the present invention is not limited the above-described embodiment. For example, the present invention is not limited to a home antenna for a digital radio receiver and may be applied to an antenna device for receiving a GPS signal, and an antenna device for mobile communication for receiving satellite waves and ground waves.

What is claimed is:

1. An antenna device, comprising:

a base portion;

a hinge portion formed on the base portion;

an antenna portion attached to the hinge portion so as to be pivotable thereabout, wherein:

the hinge portion includes:

a hinge base having a first shaft formed on one end thereof, a second shaft formed on the other end thereof, and a first protrusion formed on an outer periphery of the second shaft; and a hinge bush rotatably mounted on the first shaft and engaged with the antenna portion;

the antenna portion is formed with a hole surrounding the outer periphery of the second shaft;

a projection is formed on an inner periphery of the hole; and the first protrusion is brought into contact with the projection when the antenna portion is pivoted so as to define a predetermined angle with respect to the base portion.

2. The antenna device as set forth in claim 1, wherein:

an outer periphery of the first shaft has a first tapered face;

an inner periphery of the hinge bush has a second tapered face corresponding to the first tapered face; and the hinge portion includes an coil spring urging the hinge bush toward the first tapered face.

3. The antenna device as set forth in claim 1, wherein:

the antenna portion is operable to pivot about the hinge portion in a first direction;

the hinge base has a second protrusion formed on the outer periphery of the second shaft;

the antenna portion has a wall portion formed on the inner periphery of the antenna portion; and the wall portion is brought into contact with the second protrusion so that the antenna portion is not pivot in the first direction when the antenna portion defines a right angle with respect to the base portion.

4. The antenna device as set forth in claim 1, wherein:

the hinge bush is comprised of at least one of ABS resin, ASA resin, and PC resin.

5. An antenna device, comprising:

an antenna portion;

a hinge portion formed on the antenna portion;

a base portion attached to the hinge portion so as to be pivotable thereabout, wherein:

the hinge portion includes:

a hinge base having a first shaft formed on one end thereof, a second shaft formed on the other end thereof, and a first protrusion formed on an outer periphery of the second shaft; and a hinge bush rotatably mounted on the first shaft and engaged with the base potion;

the base portion is formed with a hole surrounding the outer periphery of the second shaft;

a projection is formed on an inner periphery of the hole; and the first protrusion is brought into contact with the projection when the base portion is pivoted so as to define a predetermined angle with respect to the antenna portion.

6. The antenna device as set forth in claim 5, wherin:

an outer periphery of the first shaft has a first tapered face;

an inner periphery of the hinge bush has a second tapered face corresponding to the first tapered face; and the hinge portion includes an coil spring urging the hinge bush toward the first tapered face.

7. The antenna device as set forth in claim 5, wherein:

the base portion is operable to pivot about the hinge portion in a first direction;

the hinge base has a second protrusion formed on the outer periphery of the second shaft;

the base portion has a wall portion formed on the inner periphery of the base portion; and the wall portion is brought into contact with the second protrusion so that the base portion is not pivot in the first direction when the base portion defines a right angle with respect to the antenna portion.

8. The antenna device as set forth in claim 5, wherein:

the hinge bush is comprised of at least one of ABS resin, ASA resin, and PC resin.

* * * * *